US011438994B2

(12) United States Patent
Chen et al.

(10) Patent No.: US 11,438,994 B2
(45) Date of Patent: Sep. 6, 2022

(54) FILAMENT CURRENT CONTROL METHOD AND APPARATUS

(71) Applicant: SUZHOU POWERSITE ELECTRIC CO., LTD., Jiangsu (CN)

(72) Inventors: Fei Chen, Jiangsu (CN); Shengfang Fan, Jiangsu (CN); Qiang Huang, Jiangsu (CN); Wanquan Wang, Jiangsu (CN)

(73) Assignee: Suzhou Powersite Electric Co., Ltd., Jiangsu (CN)

( * ) Notice: Subject to any disclaimer, the term of this patent is extended or adjusted under 35 U.S.C. 154(b) by 0 days.

(21) Appl. No.: 17/053,527

(22) PCT Filed: Nov. 16, 2018

(86) PCT No.: PCT/CN2018/115959
§ 371 (c)(1),
(2) Date: Nov. 6, 2020

(87) PCT Pub. No.: WO2019/214204
PCT Pub. Date: Nov. 14, 2019

(65) Prior Publication Data

US 2021/0235570 A1 Jul. 29, 2021

(30) Foreign Application Priority Data

May 9, 2018 (CN) ..... 201810438338.3

(51) Int. Cl.
*H05G 1/34* (2006.01)

(52) U.S. Cl.
CPC ..... *H05G 1/34* (2013.01)

(58) Field of Classification Search
CPC ..... H05G 1/34
See application file for complete search history.

(56) References Cited

U.S. PATENT DOCUMENTS 4,072,865 A 2/1978 Craig et al.
5,077,773 A 12/1991 Sammon
(Continued)

FOREIGN PATENT DOCUMENTS

CN 101794321 A 8/2010
CN 102291920 A 12/2011
(Continued)

OTHER PUBLICATIONS

International Search Report, Application No. PCT/CN2018/115959, dated Feb. 20, 2019.
(Continued)

*Primary Examiner* — Chih-Cheng Kao
(74) *Attorney, Agent, or Firm* — Elmore Patent Law Group, P.C.; Carolyn S. Elmore; Joseph C. Zucchero

(57) ABSTRACT

The present application discloses a method for controlling filament current and apparatus. The method comprises: acquiring a current filament current value (S11); determining a current range within which the current filament current value falls (S12); determining a correspondence between a filament current and a control current according to the current range (S13); and determining the current control current according to the current filament current value and the correspondence (S14). The problem of large errors in the control of filament current caused by nonlinear characteristics of a filament transformer can be solved.

5 Claims, 5 Drawing Sheets

(56) References Cited

U.S. PATENT DOCUMENTS

| | | | | |
|---|---|---|---|---|
| 2016/0088718 | A1* | 3/2016 | Jiang | H05G 1/085 378/110 |
| 2018/0064410 | A1 | 3/2018 | Li et al. | |
| 2018/0315579 | A1* | 11/2018 | Yonezawa | H05G 1/34 |
| 2020/0350896 | A1 | 11/2020 | Fan et al. | |

FOREIGN PATENT DOCUMENTS

| | | | |
|---|---|---|---|
| CN | 102833934 | A | 12/2012 |
| CN | 104302081 | A | 1/2015 |
| CN | 104378897 | A | 2/2015 |
| CN | 104470175 | A | 3/2015 |
| CN | 104852354 | A | 8/2015 |
| CN | 105430858 | A | 3/2016 |
| CN | 106304587 | A | 1/2017 |
| CN | 107049347 | A | 8/2017 |
| CN | 107635347 | A | 1/2018 |
| CN | 107809184 | A | 3/2018 |
| CN | 108650768 | A | 10/2018 |
| JP | H0276500 | U | 6/1990 |
| JP | H04229937 | A | 8/1992 |
| JP | H08273889 | A | 10/1996 |
| JP | H09161990 | A | 6/1997 |
| JP | 2006244940 | A | 9/2006 |
| JP | 2017027832 | A | 2/2017 |
| JP | 2017027832 | A * | 2/2017 |
| WO | 2019214204 | A1 | 11/2018 |

OTHER PUBLICATIONS

Written Opinion of the International Searching Authority, Application No. PCT/CN2018/115959, dated Feb. 20, 2019.

English translation of the first Office Action of priority Chinese Application No. 2018104383383.

English translation of the second Office Action of priority Chinese Application No. 2018104383383.

English translation of the Notification of Grant of Invention Patent of priority Chinese Application No. 2018104383383.

Zeli, et al., "Circuit Design for a Kind of X-ray Machine Heating Filament," Measurement and Control Technology, vol. 32, pp. 476-480, Dec. 2013. (English translation).

Ling, et al., "Error Analysis of Instrument Transformer and Research on Digital Automatic Compensation Method," Journal of Xi'an Jiaotong University, vol. 31 (11), pp. 99-104, Nov. 1997 (English translation).

Extended European Search Report, Application No. 18917616.7, dated Jun. 11, 2021.

English translation of the First Office Action Japanese Application No. 2021-512980 dated Dec. 7, 2021.

Invitation pursuant to Rule 137(4) EPC and Article 94(3) EPC in EP18917616.7, dated May 2, 2022.

* cited by examiner

FILAMENT CURRENT CONTROL METHOD AND APPARATUS

RELATED APPLICATIONS

This application is a US National stage entry of International Application No. PCT/CN2018/115959, filed on Nov. 16, 2018, published in Chinese. This application claims priority to Chinese, Application No. 201810438338.3, filed May 9, 2018. The entire teachings of the above applications are incorporated herein by reference.

TECHNICAL FIELD

The present application relates to the field of medical instruments, in particular to a method and a device for controlling filament current.

BACKGROUND

The tube current of an X-ray tube determines the amount of X-ray radiation that has a decisive influence on the quality of diagnosis and treatment. In an X-ray tube, the tube current is formed by the electrons excited by a heated filament under the action of a high voltage electric field. The magnitude of the tube current is affected by the temperature of the filament, which in turn depends on the current of the filament. That is to say, the magnitude of the filament current affects the amount of X-ray radiation of the X-ray tube, and is therefore of great importance for the control of the filament current.

FIG. 1 illustrates a topological structure of a filament power supply circuit in the prior art. As shown in FIG. 1, when the filament current is controlled by a filament transformer, if it is an ideal filament transformer, when the primary current is converted to a secondary current, the converted secondary current should be equal to the actual filament current. However, due to the nonlinearity of the actual filament transformer, the converted secondary current is not equal to the actual filament current, causing a large error in the control of the filament current.

SUMMARY

In view of this, embodiments of the present application provide a method and a device for controlling filament current, to solve the problem of large errors in the control of filament current due to the nonlinear characteristics of a filament transformer.

According to a first aspect, an embodiment of the present application provides a method for controlling filament current, including: acquiring a current filament current value; determining a current range in which the current filament current value falls; determining a correspondence between the filament current and a corresponding control current according to the current range; and determining a current control current according to the current filament current value and the correspondence.

In conjunction with the first aspect, in a first implementation of the first aspect, determining a current control current according to the current filament current value and the correspondence comprises: calculating the current control current $i_p$ by the following formula according to the current filament current value and the correspondence:

$$i_p = \frac{i_{p(a+1)} - i_{pa}}{i_{s(a+1)} - i_{sa}} \times (i_s - i_{sa}) + i_{pa}$$

wherein $i_{sa}$ and $i_{s(a+1)}$ are current values at two end points of the current range in which the current filament current falls; $i_{pa}$ and $i_{p(a+1)}$ are current values of corresponding control current measured according to the current values at the two end points; and is the current filament current value.

In conjunction with the first aspect or the first implementation of the first aspect, in a second implementation of the first aspect, the correspondence between the filament current and the control current is acquired by the following steps: dividing a working range of the filament current into a plurality of consecutive current ranges; and calculating the correspondence between the filament current and the control current in any one of the current ranges respectively.

In conjunction with the second implementation of the first aspect, in a third implementation of the first aspect, dividing a working range of the filament current into a plurality of consecutive current ranges comprises: selecting current values of N points in a working range of the filament current; and dividing the working range into N+1 consecutive current ranges of the filament current value by the N points; wherein the N points are unevenly distributed in the working range of the filament current.

In conjunction with the third implementation of the first aspect, in a fourth implementation of the first aspect, the N points are distributed from sparse to densely as the filament current changes from low to high over the working range.

In conjunction with the second implementation of the first aspect, in a fifth implementation of the first aspect, calculating the correspondence between the filament current and the control current in any one of the current ranges respectively comprises: determining current values at the two end points of the current range in any one of the current ranges; measuring a corresponding control current of a filament transformer according to the current values at the two end points; and calculating correspondence between the filament current and the control current in the current range according to the current values at the two end points of the current range and the corresponding control current of the filament transformer measured.

According to a second aspect, an embodiment of the present application provides a device for controlling filament current, including: an acquisition module, configured to obtain a current filament current value; an analysis module, configured to determine a current range in which the current filament current value falls; a determination module, configured to determine a correspondence between a filament current and a corresponding control current according to the current range; and a processing module, configured to determine a current control current according to the current filament current value and the correspondence.

In conjunction with the first aspect, in a first implementation of the first aspect, the processing module includes:

a calculating unit, configured to calculate a current control current $i_p$ by using the following formula according to the current filament current value and the correspondence:

$$i_p = \frac{i_{p(a+1)} - i_{pa}}{i_{s(a+1)} - i_{sa}} \times (i_s - i_{sa}) + i_{pa}$$

wherein $i_{sa}$ and $i_{s(a+1)}$ are current values at two end points of the current range in which the current filament current falls; $i_{pa}$ and $i_{p(a+1)}$ are current values of corresponding control current measured according to the current values at the two end points; and is the current filament current value.

According to a third aspect, an embodiment of the present application provides a server, including: memory and a processor, wherein the memory and the processor are in communication with each other, the memory stores computer instructions thereon, and the processor performs the method for controlling filament current in any of the above embodiments.

According to a fourth aspect, an embodiment of the present application provides a computer readable storage medium storing computer instructions for causing a computer to perform the method for controlling filament current in any of the above embodiments.

In the embodiments of the present application, the method of acquiring a current filament current value; determining a current range in which the current filament current value falls; determining a correspondence between the filament current and a corresponding control current according to the current range; and determining a current control current according to the current filament current value and the correspondence solves the problem of a large error in the control of the filament current due to the nonlinear characteristic of the filament transformer, and improves the precision of control of the filament current.

BRIEF DESCRIPTION OF THE DRAWINGS

The features and advantages of the present application are more clearly understood from the following drawings which are illustrative and shall not be construed as limitative on the present application in any sense, in the drawings.

DETAILED DESCRIPTION

In order to make the purpose, technical solutions and advantages in embodiments of the present invention clearer, the technical solutions in the embodiments of the present invention will be described as follows clearly and completely referring to figures accompanying the embodiments of the present invention, and surely, the described embodiments are just part rather than all embodiments of the present invention. Based on the embodiments of the present invention, all the other embodiments acquired by those skilled in the art without delivering creative efforts shall fall into the protection scope of the present invention.

Embodiment 1

Figure 1:
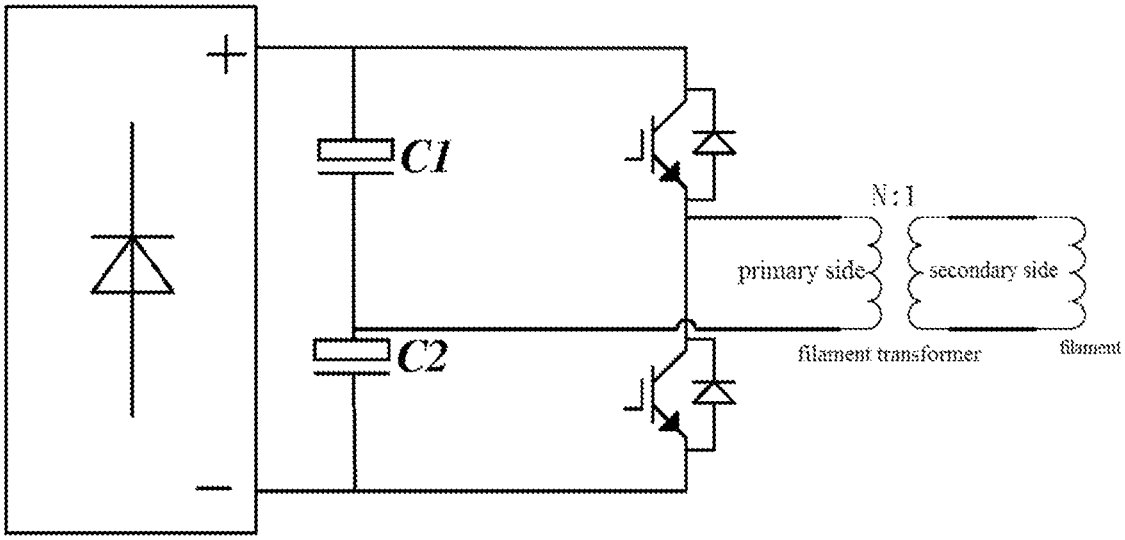
FIG. 1 is a schematic diagram showing a topology of a filament power supply circuit in the prior art.
Figure 2:
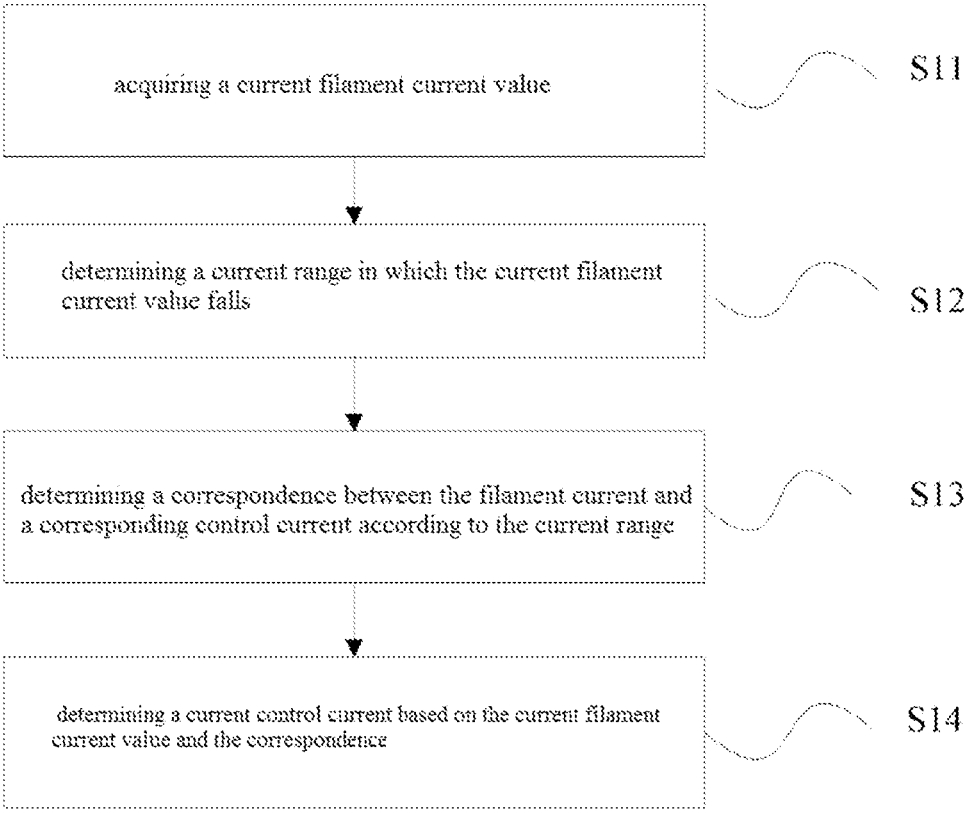
FIG. 2 is a flow chart showing an optional method for controlling filament current according to an embodiment of the present application.

The embodiment of the present application provides a method for controlling filament current. FIG. 2 is a flow chart showing an optional method for controlling filament current according to an embodiment of the present application. As shown in FIG. 2, the method includes:

Step S11, acquiring a current filament current value.

Specifically, the working range of the filament current can be expressed as $I_a$ to $I_b$. The current filament current value can be any current value within the working range.

Step S12, determining a current range in which the current filament current value falls.

Specifically, the working range of the filament current can be divided into a plurality of current ranges, and a specific current range within the working range of the filament current can be determined according to the current filament current value.

Step S13, determining a correspondence between the filament current and a corresponding control current according to the current range.

Figure 3:
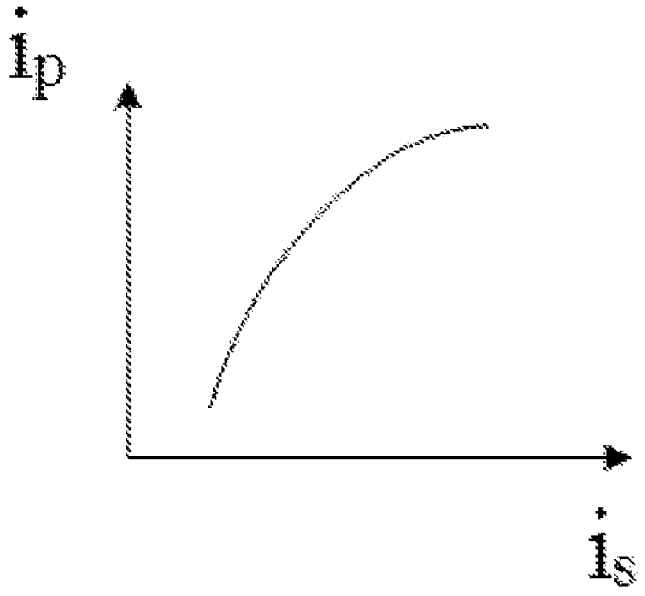
FIG. 3 is a schematic diagram showing a relationship between a control current and a filament current in a specific application scenario.

Specifically, the control current may be a secondary current converted from primary current of a filament transformer. It should be noted that, due to the nonlinear characteristics of the actual filament transformer, FIG. 3 is a schematic diagram of a curve of the relationship between the control current $i_p$ and the filament current $i_s$ in practical application scenarios. In the embodiment of the present application, the correspondence between the filament current and the control current can be further obtained by the current range in which the current filament current value falls.

Step S14, and determining a current control current based on the current filament current value and the correspondence.

In the embodiment of the present application, according to the above steps S11 to S14, the correspondence between the filament current and the control current in the current range is further determined, by determining the specific current range of the current filament current value in the working range, the current mode of current control is determined according to the current filament current and the correspondence. In an ideal case, the present application improves control precision, and solves the problem of large error in the control of filament current caused by the nonlinear characteristics of the filament transformer compared with the method of taking the current filament current value as the current control current when assuming that the control current is equal to the filament current.

In some optional implementations of the present application, Step S14 may include:

calculating the current control current $i_p$ by the following formula according to the current filament current value and the correspondence:

$$i_p = \frac{i_{p(a+1)} - i_{pa}}{i_{s(a+1)} - i_{sa}} \times (i_s - i_{sa}) + i_{pa}$$

wherein $i_{sa}$ and $i_{s(a+1)}$ are current values at two end points of the current range in which the current filament current falls; $i_{pa}$ and $i_{p(a+1)}$ are current values of corresponding control current measured according to the current values at the two end points; and is the current filament current value.

In some optional implementation of the present application, the correspondence between the filament current and the control current in step S13 above may be obtained according to the following steps:

Step S21: dividing a working range of the filament current into a plurality of consecutive current ranges.

Step S22: calculating the correspondence between the filament current and the control current in any one of the current ranges respectively.

Specifically, taking the working range of the filament current of 0-5 amps as an example, the working range of the filament current can be divided into five consecutive current ranges. For example, five consecutive current ranges can be 0-1 amps, 1-2 amps, 2-3 amps, 3-4 amps, and 4-5 amps, respectively. For the above five current ranges, the correspondence between the filament current and the control current in any one of the current ranges can be calculated. The calculation method may include the steps of selecting at least one current value in any current range, measuring a corresponding control current when the filament current is the current value, and determining the correspondence between the filament current and the control current in the current range according to the current value and the measured control current. In the embodiment of the present application, the accuracy of the correspondence between the filament current and the control current of the filament current in the working range is improved, by dividing a plurality of current ranges, respectively determining the correspondence between the filament current and the control current in any one of the current ranges.

It should be noted that, in the embodiment of the present application, when the working range of the filament current is divided into a plurality of consecutive current ranges, the more the current range is divided, the more accurate the calculated correspondence between the filament current and the control current, the smaller the error of the finally determined control current, and the higher the control accuracy.

In some optional implementations of the present application, dividing the working range of the filament current into a plurality of consecutive current ranges in the above step S21 may include:

selecting current values of N points in the working range of the filament current; and dividing the working range into N+1 consecutive current ranges of the filament current values by the N points.

Specifically, the N points may be evenly distributed in the working range of the filament current, or may be distributed in the working range of the filament current unevenly. When the N points are unevenly distributed in the working range of the filament current, the N points can be distributed from sparse to dense as the filament current varies from low to high. For example, when N=7 and the working range of the filament current is 0-5 amps, two points can be selected in the range of 0-2 amps, and five points can be selected in the range of 2-5 amps.

It should be noted that when the filament current is low, the difference between the control current and the filament current is small; when the filament current is high, the difference between the control current and the filament current is large. And in practical applications, the filament current mainly works in the second half of the working range. Therefore, it is possible to improve the accuracy when calculating the control current by arranging the N points from sparse to dense as the filament current varies from low to high, and dividing different current ranges more densely in the main working current range of the filament current.

In some optional implementations of the present application, in the foregoing step S22, respectively calculating the correspondence between the filament current and the control current in any one of the current ranges may include:

determining current values at the two end points of the current range in any one of the current ranges;

measuring a corresponding control current of a filament transformer according to the current values at the two end points; and calculating correspondence between the filament current and the control current in the current range according to the current values at the two end points of the current range and the corresponding control current of the filament transformer measured.

Specifically, for any one current filament current value is, the current range in which it falls can be expressed as $[i_{sa}, i_{s(a+1)}]$, where $1 \le a \le N$, and the control current corresponds to two end points $i_{sa}$ and $i_{s(a+1)}$ of the current range can be separately measured, and the measured control current can be recorded as $i_{pa}$ and $i_{p(a+1)}$, respectively. According to $i_{sa}$, $i_{s(a+1)}$, $i_{pa}$ and $i_{p(a+1)}$, *the correspondence between the filament current and the control current in the current range can be calculated.*

Embodiment 2

Figure 4:
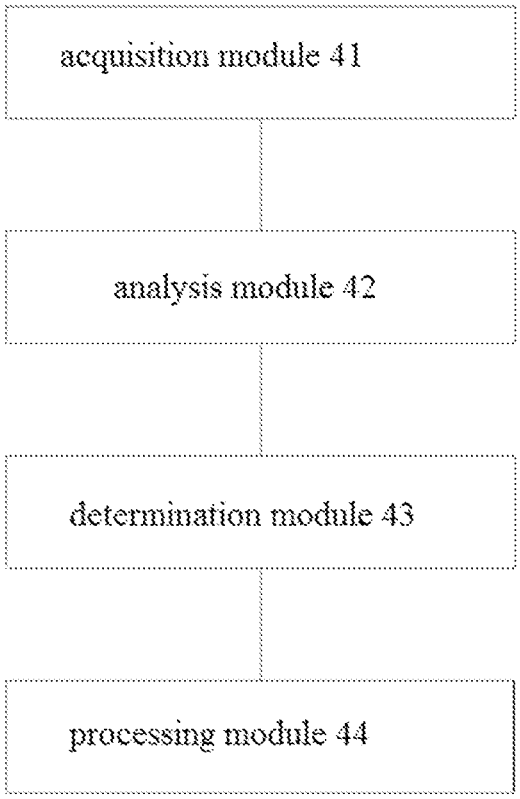
FIG. 4 shows a schematic diagram of an optional device for controlling filament current according to an embodiment of the present application.

According to an embodiment of the present application, a device for controlling filament current is provided. FIG. 4 is a schematic diagram of an optional device for controlling filament current according to an embodiment of the present application. As shown in FIG. 4, the device includes:

an acquisition module 41, referring to the description in Step S11 in the first embodiment, configured to acquire a current filament current value;

an analysis module 42, referring to the description in Step S12 in the first embodiment, configured to determine a current range in which the current filament current value falls;

a determination module 43, referring to the description in Step S13 in the first embodiment, configured to determine a correspondence between the corresponding filament current and the control current according to the current range; and a processing module 44, referring to the description in Step S14 in the first embodiment, configured to determine a current control current according to the current filament current value and the correspondence.

In the embodiment of the present application, the problem of large errors in the control of the filament current caused by the nonlinear characteristic of the filament transformer is solved, by the acquisition module 41 configured to acquire a current filament current value, the analyzing module 42 configured to determine a current range in which the current filament current value falls; the determination module 43 configured to determine the correspondence between the filament current and the corresponding control current according to the current range, and the processing module 44 configured to determine the current control current according to the current filament current value and the correspondence.

In some optional implementations of the present application, the processing module includes:

a calculating unit, configured to calculate a current control current $i_p$ by using the following formula according to the current filament current value and the correspondence:

$$i_p = \frac{i_{p(a+1)} - i_{pa}}{i_{s(a+1)} - i_{sa}} \times (i_s - i_{sa}) + i_{pa}$$

wherein $i_{sa}$ and $i_{s(a+1)}$ are current values at two end points of the current range in which the current filament current falls; $i_{pa}$ and $i_{p(a+1)}$ are current values of corresponding control current measured according to the current values at the two end points; and is the current filament current value.

Embodiment 3

Figure 5:
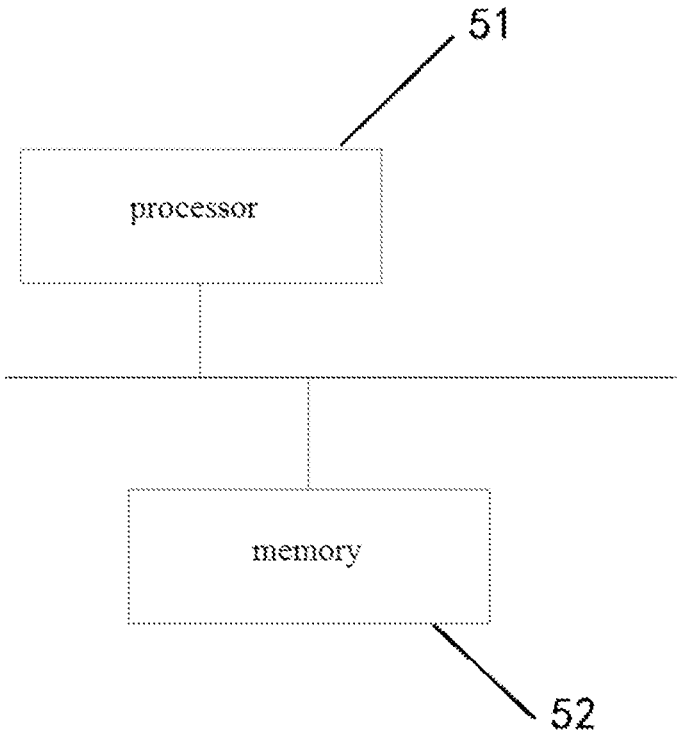
FIG. 5 shows a schematic diagram of an optional server according to an embodiment of the present application.

The embodiment of the present application further provides a server. As shown in FIG. 5, the server may include a processor 51 and memory 52, which may be connected by a bus or other manners, and as an example, the bus connection is illustrated in FIG. 5.

The processor 51 can be a central processing unit (CPU). The processor 51 can also be other general-purpose processor, a digital signal processor (DSP), an application specific integrated circuit (Application Specific Integrated Circuit, ASIC), a field-programmable gate array (Field-Programmable Gate Array, FPGA), or other programmable logic devices, discrete gates or transistor logic devices, discrete hardware components, etc., or a combination of the above various types of chips.

The memory 52, as a non-transitory computer readable storage medium, can be used for storing a non-transitory software program, a non-transitory computer executable program and module, such as a program instruction/module corresponding to the button shielding method of the vehicle display device in the embodiment of the present application (for example, the acquisition module 41, the analysis module 42, the determination module 43, and the processing module 44 shown in FIG. 4). The processor 51 executes various functional applications and data processing of the processor, that is, implementing the method for controlling filament current in the above method embodiments, by running non-transitory software programs, instructions, and modules stored in the memory 52.

The memory 52 may include a storage program area and a storage data area, wherein the storage program area may store an operating system, an application required for at least one function; the storage data area may store data created by the processor 51, and the like. Moreover, the memory 52 can include high speed random access memory, and can also include non-transitory memory, such as at least one magnetic disk storage device, flash memory device, or other non-transitory solid state storage device. In some embodiments, the memory 52 may optionally include memory remotely located relative to processor 51, which may be coupled to processor 51 via a network. Examples of such networks include, but are not limited to, the Internet, intranets, local area networks, mobile communication networks, and combinations thereof.

The one or more modules are stored in the memory 52, and when executed by the processor 51, perform the method for controlling filament current in the embodiment shown in FIG. 2.

The specific details of the foregoing server may be understood by referring to the corresponding related descriptions and effects in the embodiment shown in FIG. 2, and details are not described herein again.

It can be understood by those skilled in the art that all or part of the processes in the foregoing embodiments may be implemented by related hardware under instruction by a computer program, and the program may be stored in a computer readable storage medium, and when executed, can include the flow of the embodiment of the methods as described above. The storage medium may be a magnetic disk, an optical disk, a read-only memory (Read-Only Memory, ROM), a random access memory (Random Access Memory, RAM), a flash memory (Flash Memory), a hard disk (Hard Disk Drive, abbreviated as: HDD) or Solid-State Drive (Solid-State Drive, SSD), etc.; the storage medium may also include a combination of the above types of memories.

Although embodiments of the present application have been described in conjunction with the drawings, those skilled in the art can make various modifications and variations without departing from the spirit and scope of the present application, and such modifications and variations fall within the scope defined by the appended claims.

The invention claimed is:

1. A method for controlling an X-ray tube, the X-ray tube having a filament and a filament transformer, wherein the method comprises:

selecting current values of N points in a working range of filament current, and dividing the working range into N+1 consecutive current ranges by the N points, wherein the N points are unevenly distributed in the working range of filament current;

detecting a filament current value;

selecting, from the N+1 consecutive current ranges, a current range in which the detected filament current value falls;

calculating a primary current value $i_p$ of the filament transformer according to the selected current range by the following formula:

$$i_p = \frac{i_{p(a+1)} - i_{pa}}{i_{s(a+1)} - i_{sa}} \times (i_s - i_{sa}) + i_{pa}$$

wherein $i_{sa}$ and $i_{s(a+1)}$ are filament current values at two end points of the selected current range; $i_{pa}$ and $i_{p(a+1)}$ are predetermined primary current values, measured in advance, corresponding to the filament current values at the two end points; and is the detected filament current value; and controlling a tube current of the X-ray tube by applying the calculated primary current value $i_p$ to the filament transformer.

2. The method of claim 1, wherein the N points are distributed from sparse to dense as the filament current changes from low to high over the working range.

3. The method of claim 2, wherein the predetermined primary current values corresponding to the filament current values at the two end points of the selected current range are measured in advance by the following steps:

determining filament current values at the two end points of each current range selected from the N+1 consecutive current ranges; and measuring and recording primary current values of the filament transformer corresponding to the filament current values at the two end points, as the predetermined primary current values.

4. An electronic device, comprising:

memory and a processor, wherein the memory and the processor are in communication with each other, the memory stores computer instructions thereon, and the processor performs the method for controlling an X-ray tube in claim 1 by executing the computer instructions.

5. A device for controlling an X-ray tube, the X-ray tube having a filament and a filament transformer, wherein the device comprises:

a current range dividing module, configured to select current values of N points in a working range of filament current, and divide the working range into N+1 consecutive current ranges by the N points, wherein the N points are unevenly distributed in the working range of filament current;

a detection module, configured to detect a filament current value;

a selection module, configured to select, from the N+1 consecutive current ranges, a current range in which the detected filament current value falls;

a calculating module, configured to calculate a primary current value $i_p$ of the filament transformer according to the selected current range by the following formula:

$$i_p = \frac{i_{p(a+1)} - i_{pa}}{i_{s(a+1)} - i_{sa}} \times (i_s - i_{sa}) + i_{pa}$$

wherein $i_{sa}$ and $i_{s(a+1)}$ are filament current values at two end points of the selected current range; $i_{pa}$ and $i_{p(a+1)}$ are predetermined primary current values, measured in advance, corresponding to the filament current values at the two end points; and $i_s$ the detected filament current value; and a control module, configured to control a tube current of the X-ray tube by applying the calculated primary current value $i_p$ to the filament transformer.

* * * * *